US009345327B2

(12) United States Patent
Pierce et al.

(10) Patent No.: US 9,345,327 B2
(45) Date of Patent: May 24, 2016

(54) WALL-MOUNT VANITY BRACKET

(71) Applicants: Harry Sanford Pierce, Rome, GA (US); Rick Chambers, Miramar Beach, FL (US)

(72) Inventors: Harry Sanford Pierce, Rome, GA (US); Rick Chambers, Miramar Beach, FL (US)

(73) Assignee: BTPS, LLC, Rome, GA (US)

( * ) Notice: Subject to any disclaimer, the term of this patent is extended or adjusted under 35 U.S.C. 154(b) by 0 days.

(21) Appl. No.: 14/660,603

(22) Filed: Mar. 17, 2015

(65) Prior Publication Data

US 2015/0265051 A1 Sep. 24, 2015

Related U.S. Application Data

(60) Provisional application No. 61/955,025, filed on Mar. 18, 2014.

(51) Int. Cl.

| | |
|---|---|
| ***A47B 96/06*** | (2006.01) |
| ***A47B 96/07*** | (2006.01) |
| ***E04F 21/00*** | (2006.01) |

(52) U.S. Cl.

CPC ..... *A47B 96/07* (2013.01); *A47B 96/06* (2013.01); *E04F 21/00* (2013.01)

(58) Field of Classification Search

CPC ..... A47B 96/06; A47B 96/07; E04F 21/00

USPC ..... 52/27

See application file for complete search history.

(56) References Cited

U.S. PATENT DOCUMENTS

| | | | | | |
|---|---|---|---|---|---|
| 2,793,566 | A | * | 5/1957 | Burtchaell | 248/468 |
| 3,364,503 | A | | 1/1968 | Mustee | |
| 3,428,968 | A | | 2/1969 | Ory, Jr. et al. | |
| 3,791,709 | A | | 2/1974 | Cross | |
| 4,128,234 | A | * | 12/1978 | McKee | 269/97 |
| 4,143,429 | A | | 3/1979 | Seymour et al. | |
| 4,437,712 | A | | 3/1984 | Wissinger | |
| 4,588,156 | A | | 5/1986 | Doke et al. | |
| 4,703,593 | A | | 11/1987 | Smolik | |

(Continued)

FOREIGN PATENT DOCUMENTS

| | | | | |
|---|---|---|---|---|
| CA | 2314788 | | 1/2002 | |
| CN | 202096112 | | 4/2012 | |
| EP | 0806164 | | 11/1997 | |
| JP | 08280498 | A * | 10/1996 | A47G 1/02 |
| SE | 510351 | | 3/1997 | |

OTHER PUBLICATIONS

Wickes, "Single Slot Upright White 1000mm—Metal Shelving Systems—Shelving—Decorating & Interiors—Wickes," retrieved Jan. 21, 2014 from http://www.wickes.co.uk/invt/165149/?source=123_75, 3 pages.

(Continued)

*Primary Examiner* — James Buckle, Jr.
(74) *Attorney, Agent, or Firm* — Vedder Price P.C.

(57) ABSTRACT

A wall-mount vanity bracket may include a wall plate that is configured to be selectively connected to a wall. A flange may be connected to and extend horizontally from the wall plate which is configured to facilitate a support base for a vanity. An upright may be connected to and extend vertically from the flange, preferably from a distal end of the flange so as to define a volume configured to accept the vanity. A securing mechanism may be operatively connected to the upright configured to facilitate securement of the vanity to the bracket and contiguous with the wall.

17 Claims, 4 Drawing Sheets

(56) References Cited

U.S. PATENT DOCUMENTS

| | | | | |
|---|---|---|---|---|
| 4,879,637 | A * | 11/1989 | Clark et al. | 362/141 |
| 4,919,385 | A * | 4/1990 | Munini et al. | 248/475.1 |
| 5,117,337 | A * | 5/1992 | Sakuma | 362/492 |
| 5,141,354 | A * | 8/1992 | Morsbach | F16B 21/09 4/239 |
| 6,401,275 | B1 * | 6/2002 | Garner | 4/658 |
| 7,407,060 | B2 | 8/2008 | Swartz et al. | |
| 8,128,049 | B2 | 3/2012 | Walters | |
| 8,297,575 | B2 | 10/2012 | Kluge | |
| 8,356,367 | B2 | 1/2013 | Flynn | |
| 8,756,871 | B1 * | 6/2014 | Johnson | 52/27 |

OTHER PUBLICATIONS

Rakks Store, "Vanity Support Bracket with Wood mounting Face," retrieved Jan. 21, 2014 from http://store.rakks.com/product_info.php?products_id=287, 2 pages.

Western Safety, "Bradley 2010 Division 10 p. 6," retrieved Jan. 21, 2014 from http://www.westernsafety.com/bradley2010/bradley10Div10pg6.html, 25 pages.

* cited by examiner

WALL-MOUNT VANITY BRACKET

The present utility patent application claims priority from and the benefit of U.S. Provisional Patent Application No. 61/955,025 filed Mar. 18, 2014, entitled WALL-MOUNT VANITY BRACKET, the contents of which is hereby incorporated by reference in its entirety.

FIELD OF THE DISCLOSURE

The present disclosure is related to a wall-mount vanity bracket, and more particularly, to a unique mounting bracket and system for a quick and flexible installation of a wall-mount vanity by a home-owner or contractor.

BACKGROUND

Most wall-mount vanities require the installer to get "into" the wall cavity behind the drywall in order to install bracing or "cripples" between the wall studs. This is required given the weight load of the vanity plus the customer while using the vanity. The manner that the vanity is mounted must support 200 pound live load.

Wall-mount vanities represent a small part of the vanity category in the United Sates. However, wall-mount vanities are a much larger part of the vanity category in Europe, Asia, the Middle East, Russia, etc. The type of home or wall construction in the aforementioned countries is overwhelmingly masonry. Accordingly, there is a solid surface through the entire interior or exterior wall which allows for wall-mount vanities that can be installed utilizing masonry anchors that the vanity manufacturers provide.

Construction standard in the United States require walls to be built with wood or steel studs. Most commonly, these studs are place at 16" on center vertically with sheets of drywall screw fastened to the studs. This manner of construction results in open cavities between the studs behind the drywall. To date, most manufacturers of wall-mount vanities have not accounted for this and continue to build vanities with mounting accommodations (brackets or pre-drilled holes in the back of the vanity) that are not spaced according to 16" on center stud spacing. Moreover, the spacing of any brackets or mounting apparatus is determined by the width of the vanity itself.

Therefore, there is a need in the art for a mounting bracket or system that can be used to surface mount the vanity that accommodates the standard building practices in the United States and does not require the installer to get behind the drywall, that overcomes the aforementioned disadvantages and provides lower costs, in terms of product unit cost and installation cost.

BRIEF DESCRIPTION OF THE DRAWINGS

The following disclosure as a whole may be best understood by reference to the provided detailed description when read in conjunction with the accompanying drawings, drawing description, abstract, background, field of the disclosure, and associated headings. Identical reference numerals when found on different figures identify the same elements or a functionally equivalent element. The elements listed in the abstract are not referenced but nevertheless refer by association to the elements of the detailed description and associated disclosure.

DETAILED DESCRIPTION

Figure 1:
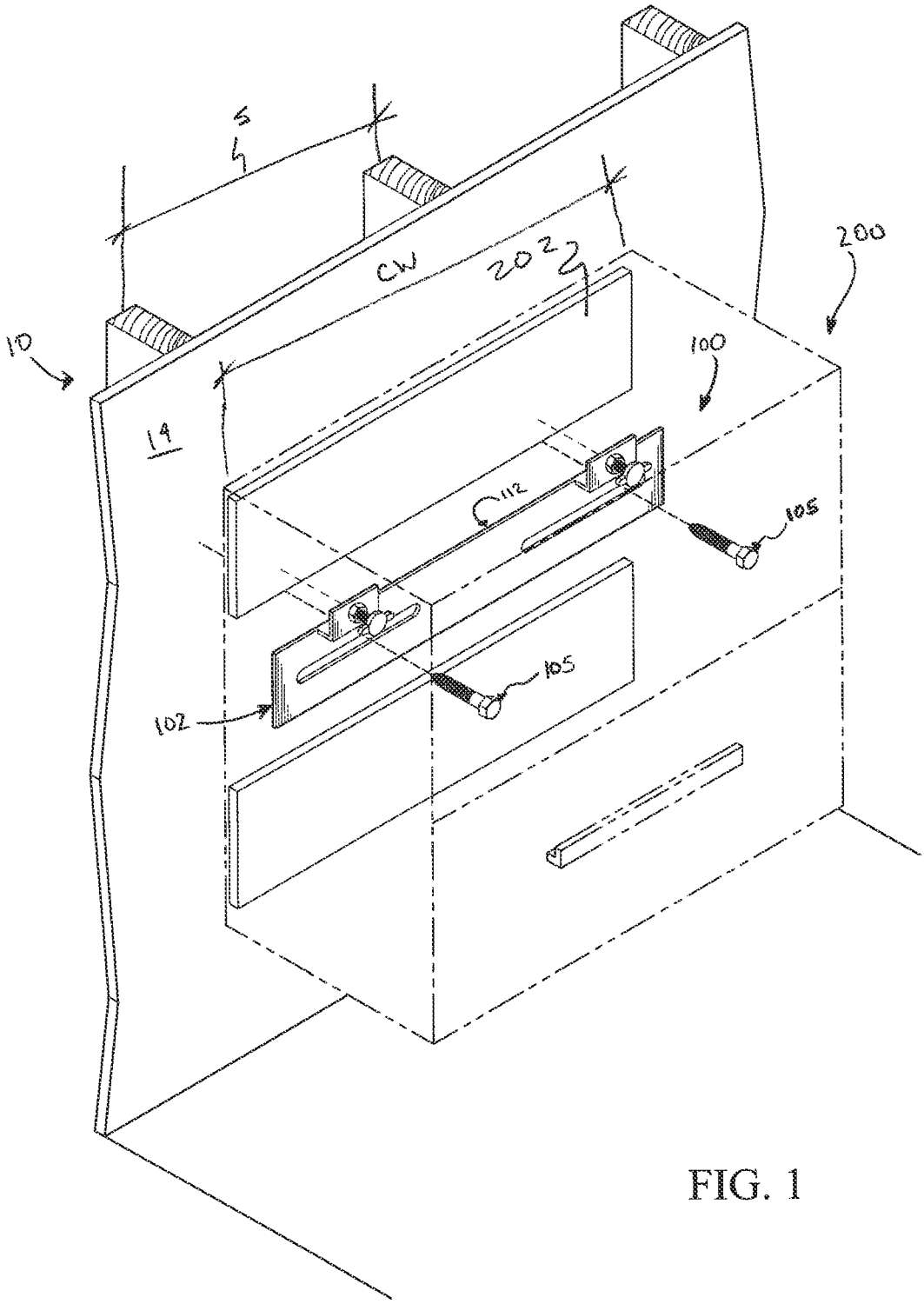
FIG. 1 is an exploded partially broken-away view of a surface mounting system for a vanity in accordance with one embodiment of the present disclosure.

The present disclosure is not limited to the particular details of the apparatus depicted, and other modifications and applications may be contemplated. Further changes may be made in the apparatus, device or methods without departing from the true spirit of the scope of the disclosure herein involved. It is intended, therefore, that the subject matter in this disclosure should be interpreted as illustrative, not in a limiting sense.

In one aspect of the present disclosure, a wall-mount vanity bracket may include a wall plate, a flange connected to and extending horizontally from the wall plate, an upright connected to and extending vertically from the flange, and a securing mechanism operatively connected to the upright.

In another aspect of the present disclosure, a surface mounting system may include a wall and a wall-mount vanity bracket. The bracket may include a wall plate, a flange connected to and extending horizontally from a top edge of the wall plate, an upright connected to and extending vertically from the flange so that the upright, wall and flange cooperatively define a volume; and a securing mechanism operatively connected to the upright that is selectively extendible into the volume.

In yet another aspect of the present disclosure, a combination may include a wall, a wall-mount vanity bracket and a vanity. The a wall plate may include at least two horizontally extending slots each having a longitudinal extent such that the sum total longitudinal extent of the slots is greater than one half a longitudinal extent of the wall plate, a pair of flanges, where each flange connected to and extends horizontally from a top edge of the wall plate and is disposed within the longitudinal extent of one of the slots, an upright connected to and extending vertically from the flange so that the upright and flange cooperatively define a volume and a securing mechanism operatively connected to the upright that is selectively extendible into the volume; and a vanity including a cleat.

In other aspects of the present disclosure, the bracket, system or combination may include: the wall plate having a thickness in the range of approximately 0.1-0.5 inches; the wall plate having at least two horizontally extending slots each having a longitudinal extent such that the sum total longitudinal extent of the slots is greater than one half a longitudinal extent of the wall plate; the wall plate having at least two horizontally extending slots and a longitudinal spacing between adjacent ends of the slots is greater than a longitudinal extent of each slot; the upright being disposed at a distal end of the flange and oriented normal to the flange; the upright being disposed approximately one inch from the wall plate; the securing mechanism having a mounting boss and a fastener that are complementarily configured to orient the fastener normal to the wall plate; and the fastener extending into the volume approximately 67% of a distance the upright is disposed from the wall or wall plate.

FIG. 1 is an exploded partially broken-away view of a surface mounting system 100 for a vanity 200 in accordance with one embodiment of the present disclosure. One of skill in the art will recognize that the term "vanity" is used specific only with respect to facilitating disclosure of one of the preferred embodiments; however, the term "vanity" shall be considered and interpreted to be used interchangeably with and merely representative of any similar or suitable structure that one desires to mount to a wall, such as, but not limited to, cabinets, sinks, desks, tables, and any other apparatus, device or structure that is desired to be mounted to a wall. The term "wall" is used specific only with respect to facilitating disclosure of one of the preferred embodiments; however, the term "wall" shall be considered and interpreted to be used interchangeably with an merely representative of any suitable structure, such as, but not limited to, any generally vertically-oriented surface. Preferably, the surface mounting system 100 may include a wall-mount vanity bracket 102 and a plurality of fasteners 105. One of skill in the art will recognize that the vanity 200, in one embodiment, may be configured with a cleat 202 that extends across the back of the vanity 200 in order to facilitate connection of the vanity to the wall 10. Below the cleat 202 on the back of the vanity 200 there is preferably an open area sufficient to facilitate connection of the vanity 200 with the wall-mount vanity bracket 102. In another embodiment, the vanity 200 may include any complementary structure, similar to a cleat 202, that provides the same intended functionality. One of skill in the art will recognize that other "vanities" may have any other suitable configurations and/or complementary structure to facilitate use of the surface mounting system 100 of the present disclosure, much like the cleat 202, for the intended functionality thereof, either alone or in combination, and all shall be interpreted and considered an interchangeable equivalents, and for the sake of brevity and consistency this disclosure will refer to all such structure and embodiments thereof as "cleats."

Figure 2:
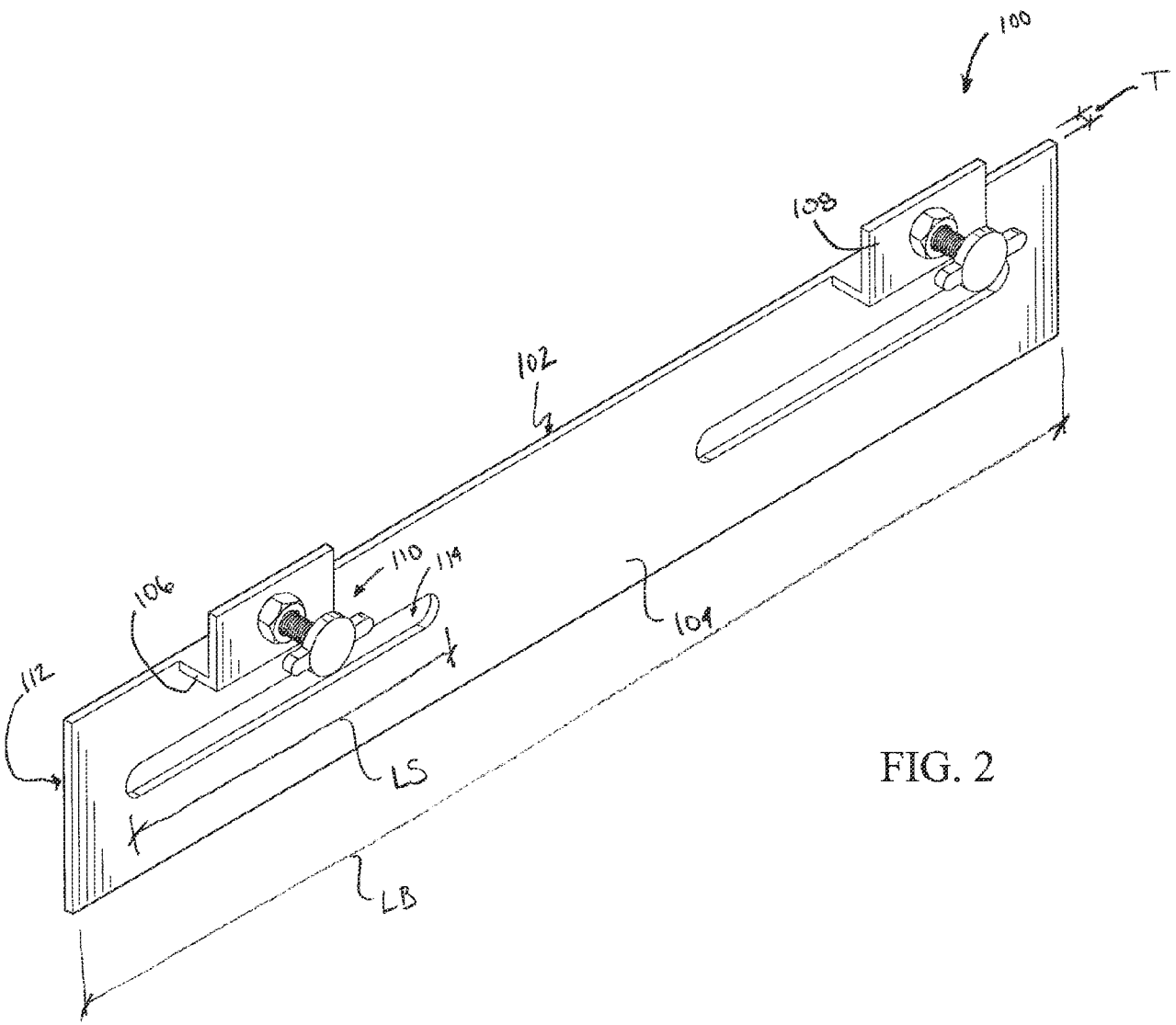
FIG. 2 is a perspective view of a surface wall-mount bracket of the system of FIG. 1 in accordance with one embodiment of the present disclosure.

FIG. 2 is a perspective view of a surface wall-mount bracket 102 of the system 100 of FIG. 1 in accordance with one embodiment of the present disclosure. The wall-mount vanity bracket 102 may include, in one embodiment, a wall plate 104, a flange 106, an upright 108 and a securing mechanism or device 110. The wall plate 104 is preferably configured to be flush mounted to a wall 10 such that an inner surface 112 of the wall plate 104 is substantially entirely contiguous with an outer surface 14 of the wall 10. One of ordinary skill in the art will recognize that the outer surface 14 may be an exterior surface (that may be painted) of drywall or sheetrock (as shown), masonry (brick, stone, concrete, etc.), furing strips, studs, or the like, etc. depending on the intended application. In one embodiment, the wall plate 104 is configured to have a thickness T that facilitates accommodation of uneven, wavy or non-straight walls, but sufficient strength for the intended application. For example, a thickness T in the range of 0.1-0.5 inches has been found satisfactory for nearly all common residential and commercial wall-mount vanities. The wall plate 104 also may include, in one embodiment, at least 2 horizontally extending slots 114 that are each configured to receive the fastener 105 in order to securely affix the bracket 104 to the wall 10. One of skill in the art will recognize that a plurality of slots may be used; however, it is preferable to use at least 2 and a few as necessary in order to provide adjustability and strengthening as described herein. Conventionally, a wall includes wall studs and a covering, such as wall board, sheet rock, gypsum board, etc. or the like, where the wall studs have a given spacing S. Alternatively, wall anchors may be connected to the wall at a desired separation distance, and both the wall anchors and the wall studs are used to provide a mounting point for a fastener 105. One of skill in the art will recognize that studs, wall anchors and other similar structures, either in like pairs or combinations of the various structures, that provide the intended functionality shall be interpreted and considered as interchangeable equivalents, and that for the sake of brevity and consistency this disclosure will refer to all such embodiments as "studs" and their separation distance as "stud spacing S."

Figure 3:
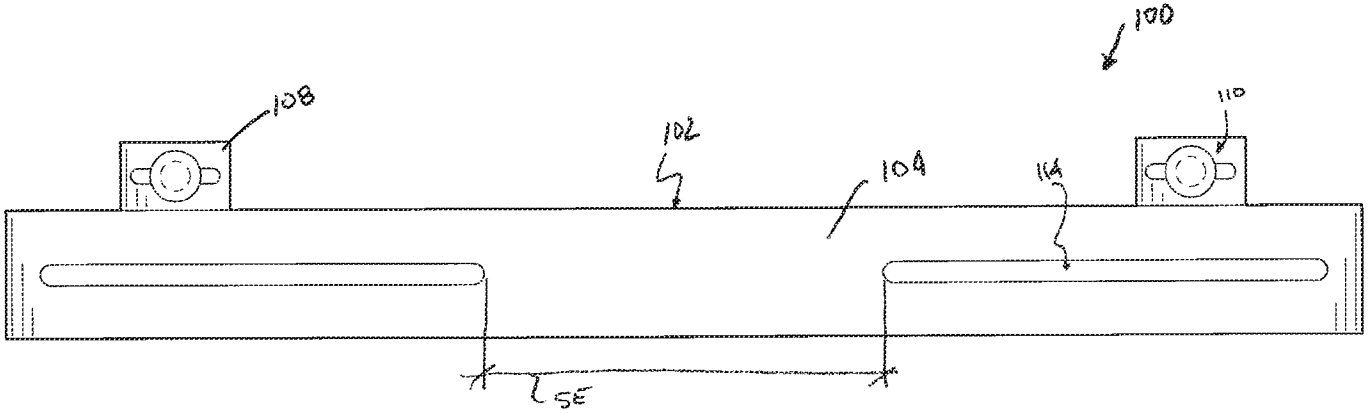
FIG. 3 is a front elevation view of the bracket of FIG. 2.

In one embodiment, the slots 114 may have a longitudinal extent LS sufficient to accommodate connection by the fasteners 105 based on a desired stud spacing S and provide horizontal adjustability with respect thereto. In another embodiment, the total longitudinal extent of the slots 114 may greater than half of the longitudinal extent LB of the bracket 102. For example, if the stud spacing S is 16 inches on center and if the longitudinal extent LB of the wall plate 104 is 20 inches, each slot 114 may be 6.25 inches. Preferably, the arrangement of the slots 114 on the wall plate 104 is configured to allow each slot 114 at least a 2 inch variance both left and right of a preferred fastener 105 connection point to accommodate different space requirements and horizontal adjustability. For example, if the stud spacing S is 16 inches on center, the longitudinal extent LB of the wall plate 104 is preferably 20 inches and the longitudinal extent LS of each slot 114 is 6.25 inches (in order to accommodate horizontal adjustment in order to affix the "vanity" to the wall in a desirable position, that may result in the centerline of the "vanity" being offset from the centerline of the bracket), then longitudinal extent of the spacing the adjacent ends SE of the slots 114 6.5 inches from one another is preferred (so that the 16 inch on center stud spacing S is easily accommodated for the fasteners 105 and a range of horizontal adjustability to the left or right is also accommodated without compromising any strength of the bracket to accommodate the desired design load). See, FIG. 3 which is a front elevation view of the bracket 102 of FIG. 2.

Figure 4:
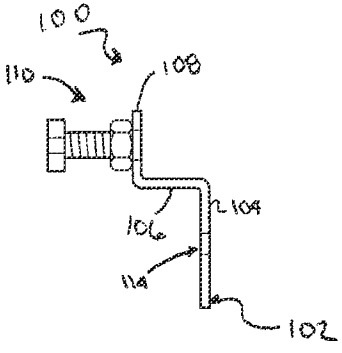
FIG. 4 is an side elevation view of the bracket of FIG. 2.

The flange 106 is connected to and extends horizontally from the top edge of the wall plate 104 away from the wall 10. Preferably, a pair of flanges 106 are disposed on the wall plate 104 sufficiently spaced apart to accommodate a wall-mount vanity having cleat 202 width CW of at least 83% of the length LB of the wall plate 104 or greater. A single flange 106 of sufficient width can be used in place of the pair or plurality of flanges 106, in another embodiment. The upright 108 is connected to and extends vertically from the flange 106 so as to cooperatively define a volume V with the flange 106 and wall 10 that is configured to receive the vanity cleat 202. Preferably, the upright 108 is disposed on a distal end of the flange 106 so as to be disposed at a distance FD from the wall 10 that is approximately 150% the thickness of the vanity cleat CT. In one embodiment, the flange 106 is disposed normal to N (or at a 90 degree angle to) the wall plate 104 and has a distal end with the upright 108 disposed normal to N (or at a 90 degree angle to) the flange and attached thereto disposed such that the distance FD is 1 inch from the wall plate 104 in order to accommodate a wide variety of conventional wall-mount vanity cleats or other connection elements. See, FIG. 4 which is a side elevation view of the bracket 102 of FIG. 2.

The securing mechanism or device 110 is operatively connected to the upright 108. In one embodiment, the securing mechanism or device 110 is a selectively movable item with respect to the upright 108, such as, for example only, a thumb screw, threaded fastener, over-center fastener, quarter-turn fastener, or the like, etc., that may be adjusted as desired and substantially temporarily fixed into the desired position by any suitable means, such as, for example only, a complementarily threaded apparatus, a threaded fastener fixed to the upright 108 that is complementary, mounting bosses configured to facilitate connection of the movable item to the upright, etc. Preferably, the securing mechanism or device 110 extends into the volume V to force the vanity cleat 202 against the wall 10 in a secure, non-movable affixed manner. In one embodiment, the securing mechanism or device 110 may extend into the volume to approximately 67% of the distance FD the upright 108 is disposed from the wall 10 or wall plate 104 so as to accommodate a wide variety of wall-mount vanities.

Figure 5:
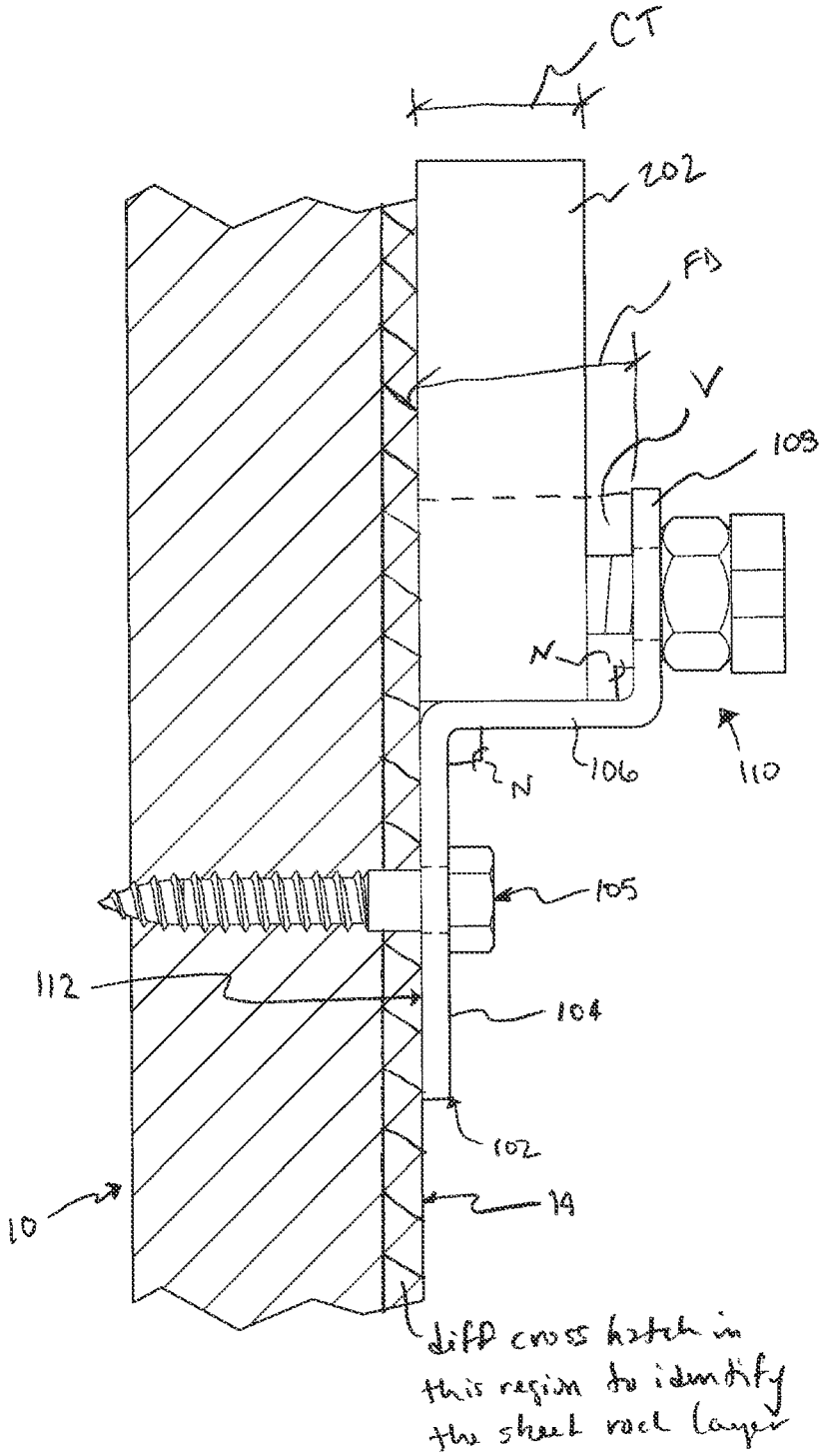
FIG. 5 is a cross section view of the assembled surface mounting system for a vanity of FIG. 1.

FIG. 5 is a cross section view of the assembled surface mounting system 100 for a vanity 200 of FIG. 1 illustrating the vanity cleat 202 disposed within the volume V and flush to the flange 106 and wall 10 as a result of the securing mechanism or device 110 (thumb screw and complementary threaded fastener connected to the upright 108 in this embodiment) so as to support at least the remainder of the vanity (not shown for the sake of clarity, but commonly understood from FIG. 1 by one of ordinary skill in the art) and the design parameter of a 200 pound live load, and the fastener 105 securing the wall plate 104 to the wall 10 such that the inner surface 112 is substantially entirely contiguous with the outer surface 14 of the wall 10.

The preceding detailed description is merely some examples and embodiments of the present disclosure and that numerous changes to the disclosed embodiments can be made in accordance with the disclosure herein without departing from its spirit or scope. The preceding description, therefore, is not meant to limit the scope of the disclosure but to provide sufficient disclosure to one of ordinary skill in the art to practice the invention without undue burden. It will be recognized by those of skill in the art that the various dimensional relations may be scaled up or down and retain the intended functionality.

The invention claimed is:

1. A wall-mount vanity bracket comprising: a wall plate; a flange connected to and extending horizontally from a top edge of the wall plate; an upright connected to and extending vertically from the flange so that the upright and flange cooperatively define a volume; and a securing mechanism operatively connected to the upright that is selectively extendible into the volume, wherein the wall plate includes at least two horizontally extending slots each having a longitudinal extent such that the sum total longitudinal extent of the slots is greater than one half a longitudinal extent of the wall plate.

2. A wall-mount vanity bracket comprising: a wall plate; a flange connected to and extending horizontally from a top edge of the wall plate; an upright connected to and extending vertically from the flange so that the upright and flange cooperatively define a volume; and a securing mechanism operatively connected to the upright that is selectively extendible into the volume, wherein the wall plate includes at least two horizontally extending slots and a longitudinal spacing between adjacent ends of the slots is greater than a longitudinal extent of each slot.

3. The bracket of claim 1, wherein the wall plate includes a thickness in the range of approximately 0.1-0.5 inches.

4. The bracket of claim 1, wherein the upright is disposed at a distal end of the flange and oriented normal to the flange.

5. The bracket of claim 4, wherein the upright is disposed approximately one inch from the wall plate.

6. A wall-mount vanity bracket comprising: a wall plate; a flange connected to and extending horizontally from a top edge of the wall plate; an upright connected to and extending vertically from the flange so that the upright and flange cooperatively define a volume; and a securing mechanism operatively connected to the upright that is selectively extendible into the volume, wherein the securing mechanism includes a mounting boss and a fastener that are complementarily configured to orient the fastener normal to the wall plate.

7. A wall-mount vanity bracket comprising: a wall plate; a flange connected to and extending horizontally from a top edge of the wall plate; an upright connected to and extending vertically from the flange so that the upright and flange cooperatively define a volume; and a securing mechanism operatively connected to the upright that is selectively extendible into the volume, wherein the fastener extends into the volume approximately 67% of a distance the upright is disposed from the wall plate.

8. A surface mounting system comprising: a wall; and a wall-mount vanity bracket including: a wall plate; a flange connected to and extending horizontally from a top edge of the wall plate; an upright connected to and extending vertically from the flange so that the upright, wall and flange cooperatively define a volume; and a securing mechanism operatively connected to the upright that is selectively extendible into the volume, wherein the wall plate includes at least two horizontally extending slots each having a longitudinal extent such that the sum total longitudinal extent of the slots is greater than one half a longitudinal extent of the wall plate.

9. The bracket of claim 8, wherein the wall plate includes at least two horizontally extending slots and a longitudinal spacing between adjacent ends of the slots is greater than a longitudinal extent of each slot.

10. The bracket of claim 8, wherein the upright is disposed at a distal end of the flange and oriented normal to the flange.

11. The bracket of claim 8, wherein the upright is disposed approximately one inch from the wall plate.

12. The bracket of claim 8, wherein the securing mechanism includes a mounting boss and a fastener that are complementarily configured to orient the fastener normal to the wall plate.

13. The bracket of claim 12, wherein the fastener extends into the volume approximately 67% of a distance the upright is disposed from the wall plate.

14. A combination comprising: a wall; a wall-mount vanity bracket including: a wall plate including at least two horizontally extending slots each having a longitudinal extent such that the sum total longitudinal extent of the slots is greater than one half a longitudinal extent of the wall plate; a pair of flanges, where each flange connected to and extends horizontally from a top edge of the wall plate and is disposed within the longitudinal extent of one of the slots; an upright connected to and extending vertically from the flange so that the upright and flange cooperatively define a volume; and a securing mechanism operatively connected to the upright that is selectively extendible into the volume; and a vanity including a cleat.

15. The combination of claim 14, wherein a longitudinal spacing between adjacent ends of the slots is greater than a longitudinal extent of each slot.

16. The combination of claim 14, wherein the upright is disposed at a distal end of the flange that is approximately 150% of a thickness of the cleat and oriented normal to the flange.

17. The combination of claim 14, wherein the securing mechanism includes a mounting boss and a fastener that are complementarily configured to orient the fastener normal to the wall plate and the fastener extends into the volume up to approximately 67% of a distance the upright is disposed from the wall to engage and secure the cleat against the wall and the flange.

* * * * *